United States Patent [19]

Bergman et al.

[11] Patent Number: 4,473,903

[45] Date of Patent: Sep. 25, 1984

[54] APPARATUS FOR POSITIONING AN ELECTRIC ARC FURNACE ELECTRODE

[75] Inventors: Kjell Bergman, Västeras; Erik Lassander, Viken, both of Sweden

[73] Assignee: ASEA Aktiebolag, Västeras, Sweden

[21] Appl. No.: 508,037

[22] Filed: Jun. 27, 1983

[30] Foreign Application Priority Data

Jun. 29, 1982 [SE] Sweden ..... 8204001

[51] Int. Cl.[3] ..... H05B 7/109

[52] U.S. Cl. ..... 373/98; 373/106

[58] Field of Search ..... 373/50, 98, 106, 94, 373/105, 81, 84

[56] References Cited

U.S. PATENT DOCUMENTS

| | | | |
|---|---|---|---|
| 2,296,734 | 9/1942 | Payne | 373/106 X |
| 2,469,740 | 5/1949 | Moore | 373/106 X |
| 2,921,107 | 1/1960 | Toothman et al. | 373/106 |
| 3,255,291 | 6/1966 | Weisgerber | 373/106 |
| 3,548,061 | 12/1970 | Gromakov | 373/106 |
| 4,423,515 | 12/1983 | Riegler et al. | 373/81 |

*Primary Examiner*—Roy N. Envall, Jr.

*Attorney, Agent, or Firm*—Kenyon & Kenyon

[57] ABSTRACT

Apparatus for positioning an arc furnace electrode which includes a verticle tubular electrode mast which is both horizontally and vertically movable. Inside the mast is a hydraulic cylinder which has a double-acting piston. When the mast is in its uppermost position it may be locked whereby hydraulic fluid is removed from above the piston. Fluid is then introduced below the piston to raise it and the piston rod to a level above the furnace platform such that the mast can be moved horizontally over the platform.

2 Claims, 3 Drawing Figures

APPARATUS FOR POSITIONING AN ELECTRIC ARC FURNACE ELECTRODE

Figure 1:
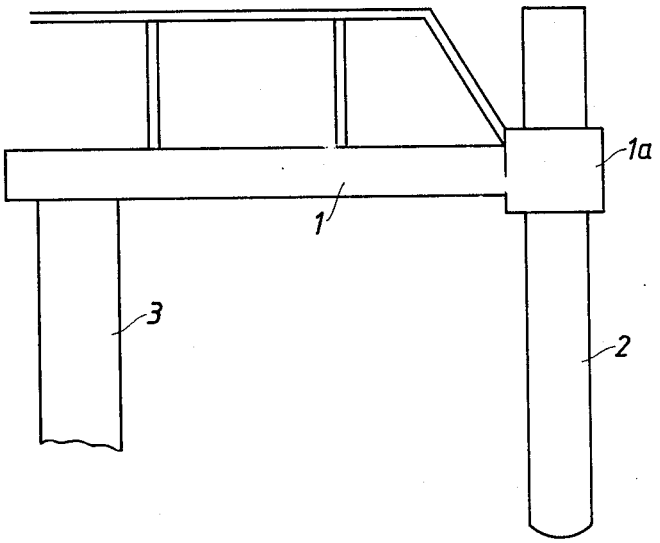

A metallurgical electric arc furnace, particularly one of the top charging type, has a removeable roof having one or more electrode holes through each of which a vertical arcing electrode depends into the furnace from an end of an overhead horizontal electrode arm the other end of which is mounted by a vertical electrode mast beside the furnace and which is powered to move up and down.

The above parts are interconnected to form an assembly which can move substantially horizontally to open the top of the furnace for charging.

The furnace has a stationary service platform beside it for workmen, which is an obstruction when the mast is hydraulically powered so as to require a cylinder and a piston having a piston rod depending to a stationary support below the level of the platform for receiving the reaction from the piston rod.

To permit the horizontal movement it is possible to make openings in the platform so as to provide clearance for the piston rod, but this is undesireable because it presents a hazard to the workmen.

As a summary of the present invention, the electrode mast is tubular, is horizontally and vertically moveable and has the electrode arm horizontally extending from the mast with an electrode holder on its outer end to mount the depending electrode. A hydraulic lifting cylinder is vertically inside of the mast with an upper end connected to the mast. The cylinder contains a double-acting piston having a downwardly extending piston rod with its lower end seperably resting on a stationary support when hydraulic fluid is introduced to the cylinder above the piston to actuate the mast vertically. For practical reasons this support must be at a level below that of the workmen's platform. The mast can be moved up and down by introducing or withdrawing hydraulic fluid from above the double-acting piston in the hydraulic cylinder. At the upper-most mast position the mast and the lower end of its hydraulic cylinder actuator are above the platform level, but the piston's piston rod remains extending downwardly so as to rest on its stationary support below the platform level. In other words, at the upper-most position of the mast the lower ends of the mast and cylinder can clear the platform, but the piston rod cannot.

The present invention provides a lock which can be actuated to lock the mast at its upper-most position. With the mast locked, the pressure on the hydraulic fluid above the piston can be released. The invention provides means for now introducing hydraulic fluid below the double-acting piston so as to move the piston and its piston rod upwardly until the lower end of the piston rod is above the level of the platform. The piston is now at its upper-most position where it can be held by maintaining pressure on the hydraulic fluid below the piston. The mast can move horizontally over the platform.

Preferably, the piston rod is in the form of two concentric tubes with the inner tube opening above the piston for the admission of hydraulic fluid to the cylinder and the outer tube having a side opening below the piston for the admission and removal of hydraulic fluid.

Figure 2:
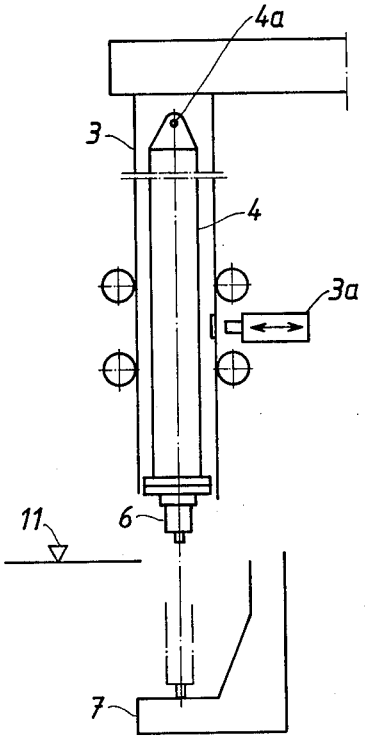
Figure 3:
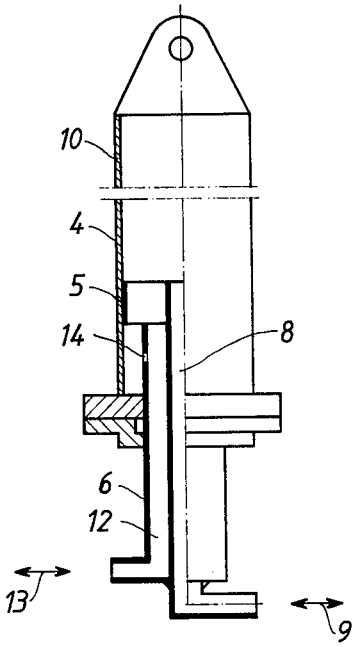

The invention is illustrated schematically by the accompanying drawings in which:

FIG. 1 is a side view showing the general organization of the mast, the electrode arm with its electrode holder, and an electrode depending from the holder;

FIG. 2 in vertical section shows the mast actuating hydraulic cylinder and piston rod, and indicates the relative levels of the workman's platform and the stationary support for providing a reaction to the downward forces exerted by the piston rod during vertical movement of the mast; and FIG. 3 in partial vertical section shows the interior of the hydraulic cylinder with its piston and piston rod which provides for selectively introducing and removing the hydraulic fluid from above and below the piston in the cylinder.

In the above drawings, FIG. 1 shows the horizontal electrode arm 1 with its electrode holder 1*a* on its outer end, an arcing electrode 2 depending from the holder, and the arm 1 extending from the vertically and horizontally moveable mast 3. The furnace roof is not shown because it is unnecessary for describing the invention.

FIG. 2 shows that the mast 3 is tubular and contains the hydraulic cylinder 4 with its upper end fixed to the upper end of the mast 3 as at 4*a*.

FIG. 3 shows that the cylinder 4 contains the double-acting piston 5 from which the piston rod 6 extends downwardly so as to rest seperably on the stationary support 7 shown in FIG. 2, when hydraulic fluid under pressure is introduced to the cylinder above the piston. The piston rod comprises the superimposed tubes with the inner-most tube 8 opening above the piston in the cylinder whereby the hydraulic fluid can be introduced and withdrawn as indicated by the double-headed arrow 9.

For normal electrode operation while the furnace (not shown) is working, the introduction and withdrawal of fluid as indicated at 9 can provide accurate electrode adjustment by vertical movements of the mast 3. When the mast must be moved horizontally for reasons explained before, fluid is introduced at 9 so as to raise the mast to the limit of its upper-most position, at which time the lock 3*a* is actuated so as to lock the mast against descent. This secures the lower end of the mast and its cylinder 4 at the position shown in FIG. 2.

Now the piston 5 can be moved to its upper-most position shown at 10 in FIG. 3, thus drawing the lower end of the piston rod 6 above the level of the platform which is indicated at 11 in FIG. 2. The piston is held at 10 by maintaining pressure on the fluid below it. The mast and its parts are now free to move horizontally above the platform level 11.

To move the piston 5 to its upper-most position hydraulic fluid is introduced to the outer-most piston rod tube 12, as indicated by the double-acting piston 5.

When the furnace roof is reclosed and the parts are swung back to their normal operating position, the lock 3*a* is released while hydraulic fluid under pressure is introduced above the cylinder 5, and of course released from below the cylinder 5, so that the piston rod 6 descends to rest on the support 7 which then carries the weight of the mast 3 and its associated parts.

What is claimed is:

1. Apparatus for positioning an electric arc furnace electrode and comprising a vertical tubular electrode mast which is horizontally and vertically moveable and from which an electrode arm horizontally extends with an electrode holder on its outer end, a hydraulic lifting cylinder vertically inside of the mast and having an upper end connected to the mast, the cylinder containing a double-acting piston having a downwardly extending piston rod having a lower end seperably resting on a stationary support when hydraulic fluid is introduced in the cylinder above the piston to raise the mast, means for locking the mast at a raised position, means for introducing and removing hydraulic fluid to and from the cylinder above the piston, and means for introducing and removing hydraulic fluid to and from the cylinder below the piston when the mast is locked at its raised position so as to lift the piston rod free from its support to a raised position.

2. The apparatus of claim 1 in which said piston rod is formed by two concentric tubes of which the inner tube opens through said piston to said cylinder and above the piston, and the outer tube has a side opening below the piston and in the cylinder.

* * * * *